US008316482B1

(12) United States Patent
Martin, III

(10) Patent No.: US 8,316,482 B1
(45) Date of Patent: Nov. 27, 2012

(54) SLEEPING ENCLOSURE FOR AN INFANT

(76) Inventor: Milane Martin, III, Riverside, CA (US)

( * ) Notice: Subject to any disclaimer, the term of this patent is extended or adjusted under 35 U.S.C. 154(b) by 0 days.

(21) Appl. No.: 13/109,141

(22) Filed: May 17, 2011

(51) Int. Cl.
*A47D 7/04* (2006.01)
*A47D 13/02* (2006.01)

(52) U.S. Cl. ..... 5/95; 5/97; 5/655

(58) Field of Classification Search ..... 5/95, 97, 5/655, 414
See application file for complete search history.

(56) References Cited

U.S. PATENT DOCUMENTS

| | | | | |
|---|---|---|---|---|
| 2,626,407 | A * | 1/1953 | Kurry | 5/99.1 |
| 2,632,186 | A | 3/1953 | Berk et al. | |
| 2,667,647 | A * | 2/1954 | Reggiani | 5/95 |
| 3,619,825 | A * | 11/1971 | Taub et al. | 5/94 |
| 3,708,808 | A * | 1/1973 | Irby | 5/95 |
| 5,341,530 | A * | 8/1994 | Ward | 5/93.1 |
| 5,819,340 | A | 10/1998 | Kelly | |
| 5,930,854 | A * | 8/1999 | O'Neill et al. | 5/655 |
| 6,026,525 | A * | 2/2000 | Davis | 5/99.1 |
| 6,848,128 | B2 * | 2/2005 | Verbovszky et al. | 5/93.1 |
| 6,862,757 | B2 | 3/2005 | Andriunas et al. | |
| 6,912,743 | B1 * | 7/2005 | Weil | 5/93.1 |
| 7,225,484 | B1 * | 6/2007 | Ortiz | 5/424 |
| 7,415,739 | B2 | 8/2008 | Tharalson et al. | |
| D576,408 | S | 9/2008 | Forshpan | |
| 7,584,514 | B1 | 9/2009 | Salas | |
| D613,091 | S | 4/2010 | Taylor | |
| 2010/0186169 | A1 * | 7/2010 | Kelly et al. | 5/655 |

* cited by examiner

*Primary Examiner* — Michael Trettel
(74) *Attorney, Agent, or Firm* — Kyle Fletcher

(57) ABSTRACT

The sleeping enclosure for an infant is comprised of a sleeping cushion and a dome-shaped net that rests atop. The sleeping enclosure is a soft pillow-like structure that is further defined by retaining walls such that an infant rests within and is incapable of rolling out of the sleeping cushion. The sleeping cushion rests and secures atop a mattress via at least one adjustable strap, which in conjunction with the sleeping cushion encircles said mattress. The dome shaped net rests atop the retaining walls and prevents objects from falling upon an infant contained within the enclosure.

15 Claims, 4 Drawing Sheets

SLEEPING ENCLOSURE FOR AN INFANT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of sleeping devices for use with infants, more specifically, a device that protects an infant from suffocation hazards associated with cribs, beds, and pets.

B. Discussion of the Prior Art

As will be discussed immediately below, no prior art discloses a sleeping cushion for an infant that includes side walls and of which is secured atop a mattress in order to provide a designated place on which an infant may sleep; wherein the sleeping cushion includes adjustable straps that secure the cushion to a mattress; wherein a removable dome-shaped net can attach onto the sleeping cushion in order to enclose an infant therein; wherein the sleeping cushion and dome-shaped net are designed to protect an infant from smothering or suffocation when in use with a mattress as well as to provide a place to enable said infant to sleep upon.

The Tharalson et al. Patent (U.S. Pat. No. 7,415,739) discloses a combination co-sleeper and changing table that includes a collapsible rigid frame and strapping members for securing to the bed. However, the co-sleeper includes a frame into which the sleeper is rested upon, and is not a devic that can mount atop a mattress and of which includes a removable dome-shaped net.

The Salas Patent (U.S. Pat. No. 7,584,514) discloses an infant sleeping apparatus for providing an infant sleeping enclosure that can rest on top of a mattress. However, the apparatus includes rigid rails to secure atop a mattress as opposed to adjustable straps that in conjucntion with a sleeping cushion shall encircle the mattress.

The Andriunas et al. Patent (U.S. Pat. No. 6,862,757) discloses a co-sleeping apparatus permitting an adult to sleep in his/her own bed and facilitating the attachment of an apparatus for comfortably and safely holding an infant or a pet so that the infant and/or pet is close proximity to the adult. However, the apparatus does not include a dome-shaped net that rests atop a sleeing cushion to enclose an infant within.

The Kelly Patent (U.S. Pat. No. 5,819,340) discloses a crib for newborns and infants that is easily placed in close proximity to the parents' bed without being physically attached thereto. However, the crib extends aside a mattress and does not mount atop said mattress.

The Berk et al. Patent (U.S. Pat. No. 2,632,186) discloses a portable combination crib and playpen that includes strap mounting support. However, the crib and playpen does not include a dome-shaped net to enclose an infant within.

While the above-described devices fulfill their respective and particular objects and requirements, they do not describe a sleeping cushion for an infant that includes side walls and of which is secured atop a mattress in order to provide a designated place on which an infant may sleep; wherein the sleeping cushion includes adjustable straps that secure the cushion to a mattress; wherein a removable dome-shaped net can attach onto the sleeping cushion in order to enclose an infant therein; wherein the sleeping cushion and dome-shaped net are designed to protect an infant from smothering or suffocation when in use with a mattress as well as to provide a place to enable said infant to sleep upon. In this regard, the sleeping enclosure for an infant departs from the conventional concepts and designs of the prior art.

SUMMARY OF THE INVENTION

The sleeping enclosure for an infant is comprised of a sleeping cushion and a dome-shaped net that rests atop. The sleeping enclosure is a soft pillow-like structure that is further defined by retaining walls such that an infant rests within and is incapable of rolling out of the sleeping cushion. The sleeping cushion rests and secures atop a mattress via at least one adjustable strap, which in conjunction with the sleeping cushion encircles said mattress. The dome shaped net rests atop the retaining walls and prevents objects from falling upon an infant contained within the enclosure.

An object of the invention is to provide an enclosure that is secured atop a mattress and provides a pillow-like surface upon which an infant may sleep and not roll out.

A further object of the invention is to provide an enclosure that by itself shall inhibit any suffocation hazard to an infant while sleeping.

A further object of the invention is to provide an enclosure that includes a dome-shaped net that rests atop the sleeping cushion to enclose a sleeping infant within.

These together with additional objects, features and advantages of the sleeping enclosure for an infant will be readily apparent to those of ordinary skill in the art upon reading the following detailed description of presently preferred, but nonetheless illustrative, embodiments of the sleeping enclosure for an infant when taken in conjunction with the accompanying drawings.

In this respect, before explaining the current embodiments of the sleeping enclosure for an infant in detail, it is to be understood that the sleeping enclosure for an infant is not limited in its applications to the details of construction and arrangements of the components set forth in the following description or illustration. Those skilled in the art will appreciate that the concept of this disclosure may be readily utilized as a basis for the design of other structures, methods, and systems for carrying out the sleeping enclosure for an infant.

It is therefore important that the claims be regarded as including such equivalent construction insofar as they do not depart from the spirit and scope of the sleeping enclosure for an infant. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
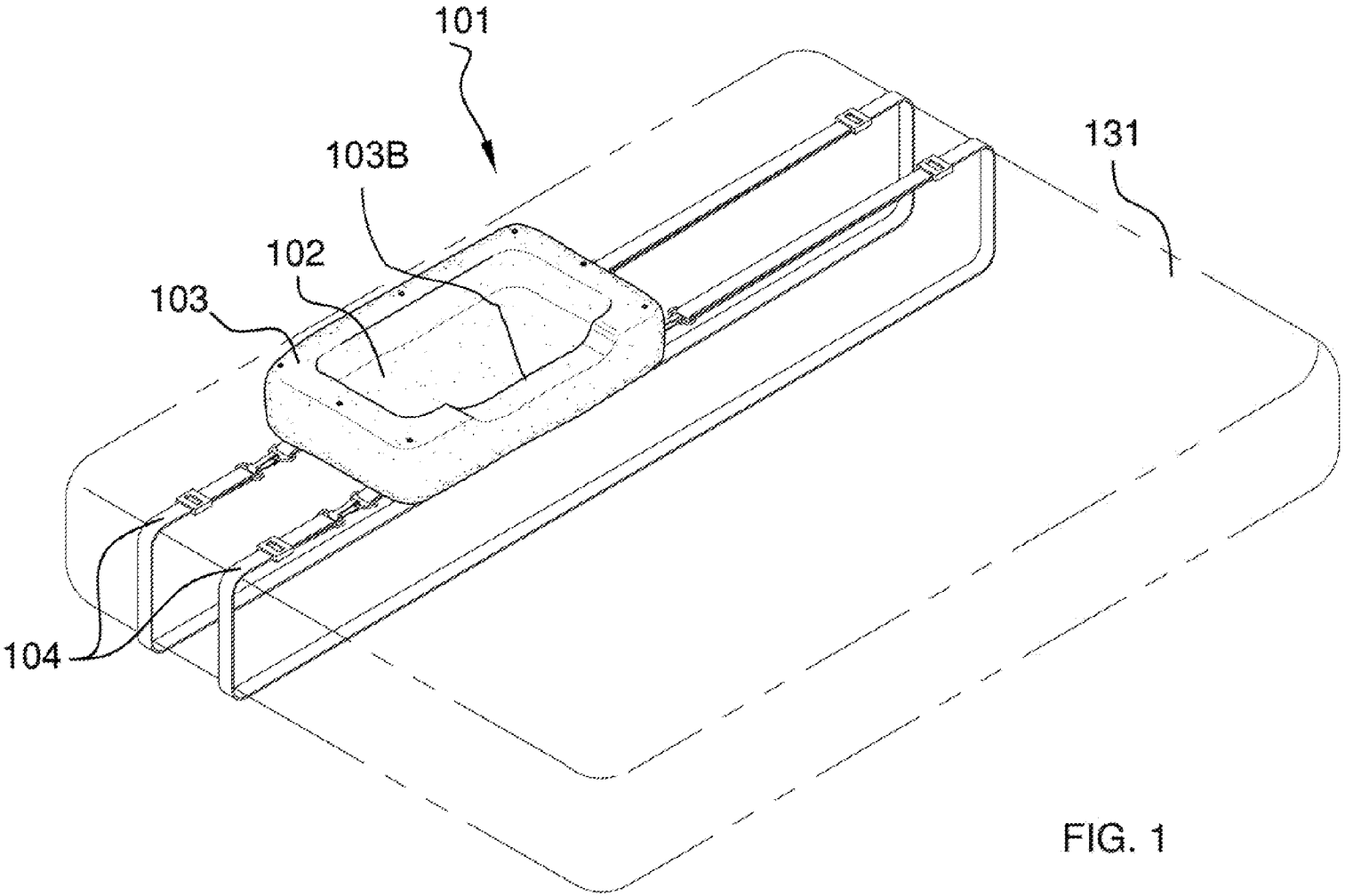
FIG. 1 illustrates an isometric view of the sleeping enclosure for an infant secured atop a mattress in which the adjustable straps and sleeping cushion encircle said mattress.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A sleeping enclosure for an infant 100 (hereinafter invention) includes a sleeping cushion 101 that is defined as a base 102 encircled about a periphery by retaining walls 103. The retaining walls 103 and the base 102 form a rectangular shape, which is ideal for laying an infant 130 upon the base 102. Both the base 102 and the retaining walls 103 are lined with a soft fabric, while the interior is filled with soft foam that is ideally suited for soothing the infant 130 to sleep (see FIG. 3).

The base 102 of the sleeping cushion 101 has a width 102B of not less than 12 inches and a length 102A of not less than 20 inches. The base 102 and the retaining walls 103 have a thickness of not less than 2 inches. The retaining walls 103 extend from the base to a height 103A of not less than 6 inches.

The sleeping cushion 101 includes a plurality of adjustable straps 104 that extends beneath the base 102, and is of an undefined length. The adjustable straps 104 attach to loops 105 that extend from each end of the base 102. The sleeping cushion 101 and the adjustable straps 104 encircle a mattress 131 in order to secure the invention 100 atop the mattress 131. The adjustable straps 104 are made of a flexible material and can conform to the cross-sectional shape of the mattress 131.

The adjustable straps 104 align the sleeping cushion lengthwise with respect to the length of the mattress 131. In other words, the infant 130 shall sleep in an orientation consistent with that of an adult sleeping on the mattress 131.

The retaining walls 103 of the sleeping cushion 101 include a concave lip 103B, which is useful for placing the infant 130 into the sleeping cushion 101. It shall be noted that the concave lip 103B shall be oriented towards the middle of the mattress 131 so that the infant 130 may not accidentally roll out of the invention 100 and fall off of the mattress 11 onto the surrounding ground.

A dome shaped net 106 is included with the invention 100 and provides a means to enclose off the top of the sleeping cushion 101. The dome shaped net 106 is important in that it prevents objects from landing atop the infant 130, which might have a smothering effect. Said objects may include small pets or stuffed animals.

Figure 2:
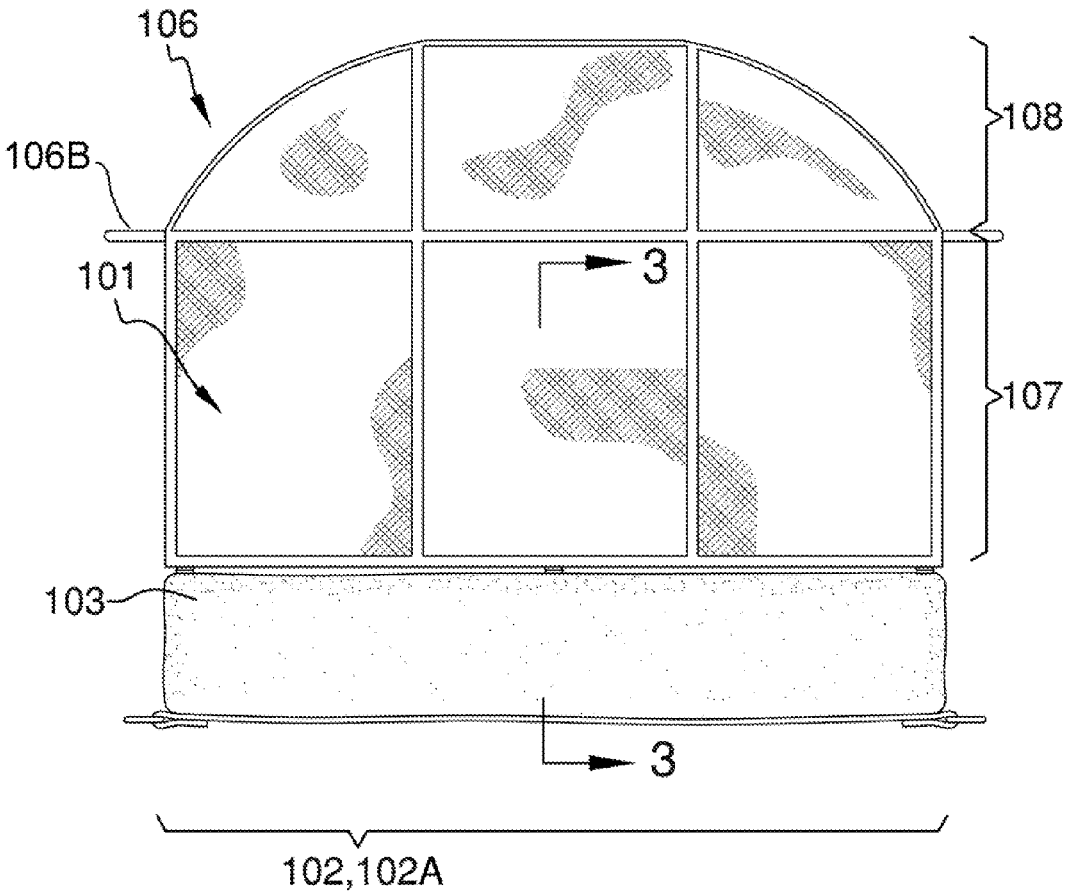
FIG. 2 illustrates a side view of the sleeping cushion by itself.
Figure 3:
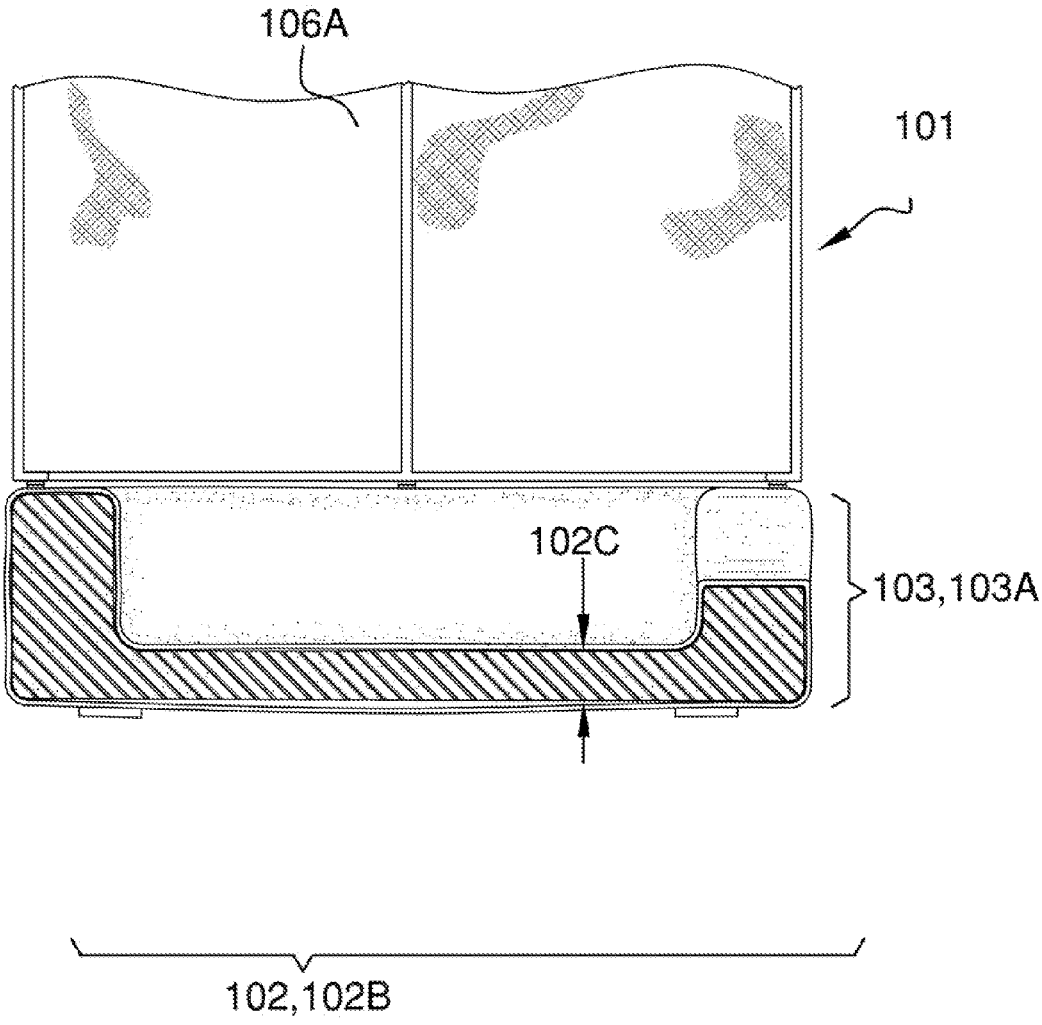
FIG. 3 illustrates a cross-sectional view of the sleeping enclosure along line 3-3 in FIG. 2, and depicting the dome shaped net positioned atop the sleeping cushion.
Figure 4:
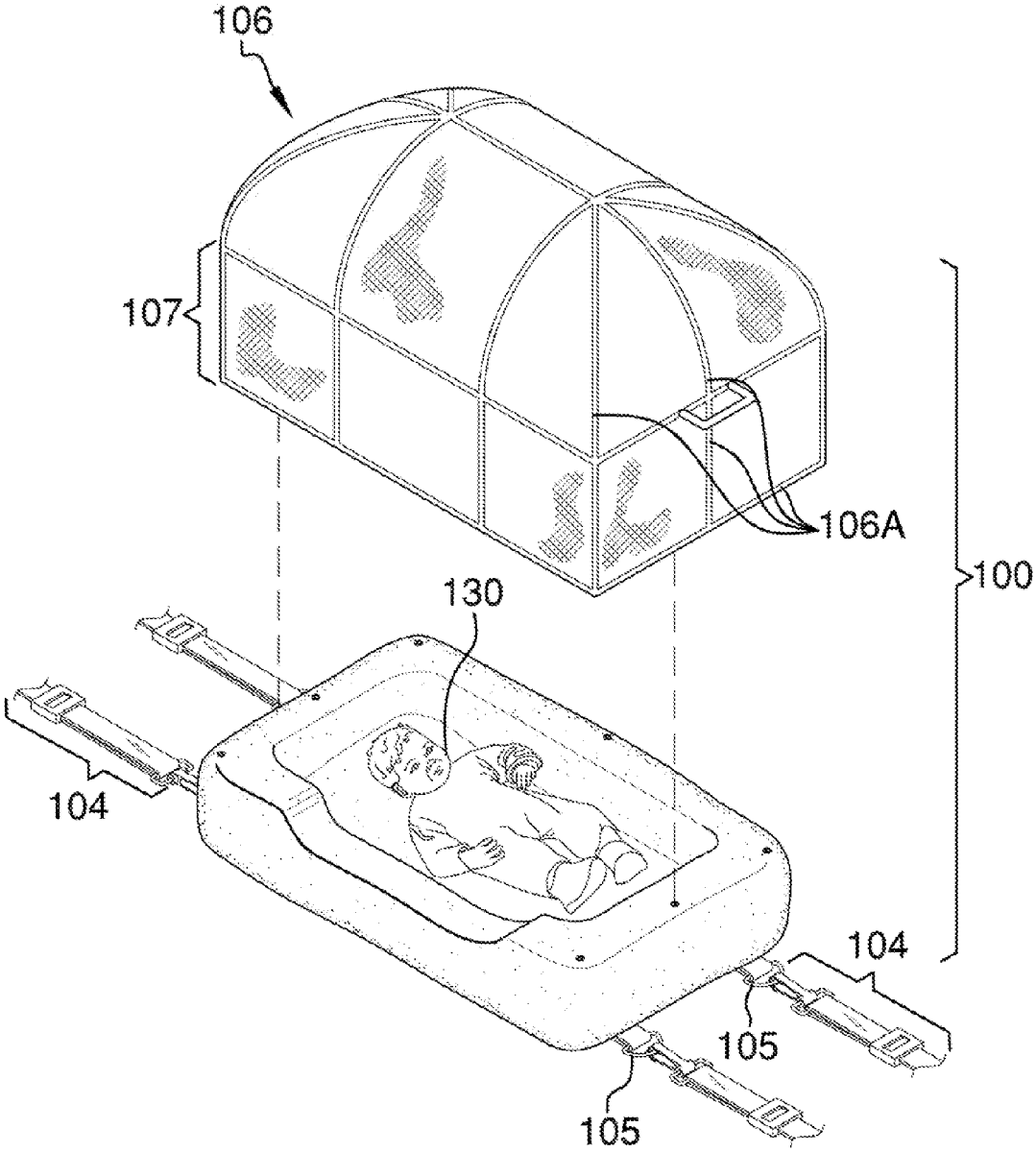
FIG. 4 illustrates an isometric view of the sleeping enclosure for an infant in which the dome shaped net is aligned above the sleeping cushion.

The dome shaped net 106 is designed to encase the retaining walls 103 of the sleeping cushion 101 (see FIGS. 2-4). The dome shaped net 106 has an area and cross-sectional shape greater than the base 102 of the sleeping cushion 101. The dome shaped net 106 is further defined by side walls 107 from which a dome 108 extends above. The side walls 107 provide enough clearance between the infant 130 sleeping on the sleeping cushion 101 and the dome 108 spanning atop. In fact, the side walls 107 shall be no less than 12 inches in height.

The dome shaped net 106 shall be composed of a net that is supported by a frame 106A. The net shall enable air to pass through the dome shaped net 106.

The dome shaped net 106 includes handles 106B on opposing ends of the dome shaped net 106 to aid in raising and lowering the dome shaped net 106 onto the sleeping cushion 101. The handles 106B are built onto the frame 106A, and are located between the side walls 107 and the dome 108.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sleeping enclosure for an infant comprising:

a sleeping cushion that is secured atop a mattress and upon which an infant is laid to sleep;

wherein the sleeping cushion is enclosed by a dome shaped net that is placed over the sleeping cushion in order to enclose the infant located therein;

wherein the sleeping cushion has a base and retaining walls that extend vertically from the base to form a periphery that surrounds said infant wherein a plurality of adjustable straps extend beneath the base;

wherein the adjustable straps attach to loops that extend from each end of the base;

wherein the dome shaped net has an area and cross-sectional shape greater than the base of the sleeping cushion;

wherein the dome shaped net is further defined by side walls from which a dome extends above; wherein handles located on opposing ends of the dome shaped net aid in raising and lowering the dome shaped net onto the sleeping cushion.

2. The sleeping enclosure for an infant as described in claim 1 wherein the retaining walls and the base form a rectangular shape; wherein the retaining walls include a concave lip to aid in placement of the infant into the sleeping cushion; wherein the concave lip is oriented towards the middle of the mattress.

3. The sleeping enclosure for an infant as described in claim 2 wherein both the base and the retaining walls are lined with a soft fabric and filled with a foam.

4. The sleeping enclosure for an infant as described in claim 1 wherein the base of the sleeping cushion has a width of not less than 12 inches and a length of not less than 20 inches.

5. The sleeping enclosure for an infant as described in claim 1 wherein the base and the retaining walls have a thickness of not less than 2 inches.

6. The sleeping enclosure for an infant as described in claim 1 wherein the retaining walls extend from the base to a height of not less than 6 inches.

7. The sleeping enclosure for an infant as described in claim 1 wherein the sleeping cushion and the adjustable straps encircle the mattress in order to secure the sleeping enclosure atop the mattress; wherein the sleeping cushion is aligned on the mattress such that an infant sleeps lengthwise with respect to the mattress.

8. The sleeping enclosure for an infant as described in claim 1 wherein the side walls shall be no less than 12 inches in height.

9. The sleeping enclosure for an infant as described in claim 8 wherein the dome shaped net shall be composed of a net that is supported by a frame.

10. A sleeping enclosure for an infant comprising:

a sleeping cushion that is secured atop a mattress and upon which an infant is laid to sleep;

wherein the sleeping cushion is enclosed by a dome shaped net that is placed over the sleeping cushion in order to enclose the infant located therein;

wherein the sleeping cushion is further defined by a base and retaining walls that extend vertically from the base to form a periphery that surrounds said infant;

wherein a plurality of adjustable straps extend beneath the base;

wherein the adjustable straps attach to loops that extend from each end of the base;

wherein the sleeping cushion and the adjustable straps encircle the mattress in order to secure the sleeping enclosure atop the mattress.

11. The sleeping enclosure for an infant as described in claim 10 wherein the retaining walls and the base form a rectangular shape; wherein both the base and the retaining walls are lined with a soft fabric and filled with a foam; wherein the base of the sleeping cushion has a width of not less than 12 inches and a length of not less than 20 inches; wherein the base and the retaining walls have a thickness of not less than 2 inches; wherein the retaining walls extend from the base to a height of not less than 6 inches; wherein the sleeping cushion is aligned on the mattress such that an infant sleeps lengthwise with respect to the mattress; wherein the retaining walls include a concave lip to aid in placement of the infant into the sleeping cushion; wherein the concave lip is oriented towards the middle of the mattress.

12. The sleeping enclosure for an infant as described in claim 10 wherein the dome shaped net has an area and cross-sectional shape greater than the base of the sleeping cushion.

13. The sleeping enclosure for an infant as described in claim 12 wherein the dome shaped net is further defined by side walls from which a dome extends above; wherein handles located on opposing ends of the dome shaped net aid in raising and lowering the dome shaped net onto the sleeping cushion.

14. The sleeping enclosure for an infant as described in claim 13 wherein the side walls shall be no less than 12 inches in height.

15. The sleeping enclosure for an infant as described in claim 14 wherein the dome shaped net shall be composed of a net that is supported by a frame.

* * * * *